US012104391B2

(12) United States Patent
Latimore

(10) Patent No.: US 12,104,391 B2
(45) Date of Patent: Oct. 1, 2024

(54) WEIGHTED TARPAULIN DEVICE

(71) Applicant: Jesse Latimore, Coconut Creek, FL (US)

(72) Inventor: Jesse Latimore, Coconut Creek, FL (US)

( * ) Notice: Subject to any disclaimer, the term of this patent is extended or adjusted under 35 U.S.C. 154(b) by 180 days.

(21) Appl. No.: 17/901,236

(22) Filed: Sep. 1, 2022

(65) Prior Publication Data

US 2024/0076888 A1 Mar. 7, 2024

(51) Int. Cl.
*E04G 21/28* (2006.01)
*E04G 21/24* (2006.01)

(52) U.S. Cl.
CPC ..... *E04G 21/28* (2013.01); *E04G 2021/248* (2013.01)

(58) Field of Classification Search
CPC .... E04G 21/28; E04G 2021/248; A47G 9/062
See application file for complete search history.

(56) References Cited

U.S. PATENT DOCUMENTS 4,590,714 A * 5/1986 Walker ..... B32B 27/26 5/417
6,192,536 B1 2/2001 Connors
6,966,152 B2 * 11/2005 Glynos ..... A01F 25/13 248/910
D806,488 S 1/2018 Cohen
10,147,332 B1 * 12/2018 Barber ..... G09B 29/001
10,517,413 B1 * 12/2019 Soucy ..... A47G 9/062
2004/0194393 A1 * 10/2004 Horman ..... E04B 1/66 52/3
2005/0005355 A1 * 1/2005 Marks ..... A47G 9/062 5/417
2006/0010598 A1 * 1/2006 Rusinak-Connors ..... A47G 9/062 5/417
2006/0150537 A1 * 7/2006 Baum ..... E04G 21/28 52/90.1
2009/0056780 A1 * 3/2009 Glynos ..... A01F 25/13 135/119
2012/0267909 A1 10/2012 Sandel
2012/0315610 A1 * 12/2012 Listim ..... G09B 1/06 434/171
2015/0147519 A1 5/2015 Siegel
2020/0056388 A1 * 2/2020 Cohen ..... B60J 7/10

FOREIGN PATENT DOCUMENTS

WO WO2006076500 7/2006

OTHER PUBLICATIONS

Anstrout, 36 Clear Pockets Classroom Pocket Chart for Cell Phones, Pocket Chart Organizer for Calculator Holder with 36 Number Sticker Classroom Hanging Cell Phones Organizer, sold at https://www.amazon.com/ANSTROUT-Classroom-Calculator-Sticker-Organizer/dp/B099DYNFPR?th=1, first avail. Jul. 14, 2021 (Year: 2021).*

* cited by examiner

*Primary Examiner* — Theodore V Adamos

(57) ABSTRACT

A weighted tarpaulin device for covering an article without moving due to wind or other environmental forces includes a tarpaulin with a plurality of pockets dispersed across a face of the tarpaulin. Each pocket is configured for holding a sandbag of a plurality of sandbags. The plurality of sandbags weigh the tarpaulin down when contained in the plurality of pockets.

11 Claims, 4 Drawing Sheets

WEIGHTED TARPAULIN DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to weighted tarpaulins and more particularly pertains to a new weighted tarpaulin for covering an article without moving due to wind or other environmental forces.

(2) Description of Related Art Including Information Disclosed Under 37 CFR 1.97 and 1.98

The prior art relates to weighted tarpaulins, many of which use sandbags placed in pockets to weigh them down. While myriad configurations exist in the prior art wherein sandbags or other weights are kept in pockets at the corners of a tarpaulin and possibly along the edges of the tarpaulin, the prior art does not disclose a device which disperses pockets across a face of the tarpaulin, including some pockets being positioned at distance from corners and edges of the tarpaulin, for weighing the tarpaulin down. Such an arrangement is advantageous over the prior art in that it allows smaller, lighter sandbags to be used to weight the tarpaulin down, easing placement of the tarpaulin. Another advantage is that wind that blows underneath the tarpaulin between sandbags or other weights will be less likely to cause the center of the tarpaulin to lift off the covered surface. This is helpful in situations where the whole of the tarpaulin is meant to abut or otherwise be positioned near the covered surface, such as for leak-prevention functions.

BRIEF SUMMARY OF THE INVENTION

An embodiment of the disclosure meets the needs presented above by generally comprising a tarpaulin with a plurality of pockets dispersed across a face of the tarpaulin.

Each pocket is configured for holding a sandbag of a plurality of sandbags. The plurality of sandbags weighs the tarpaulin down when contained in the plurality of pockets.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
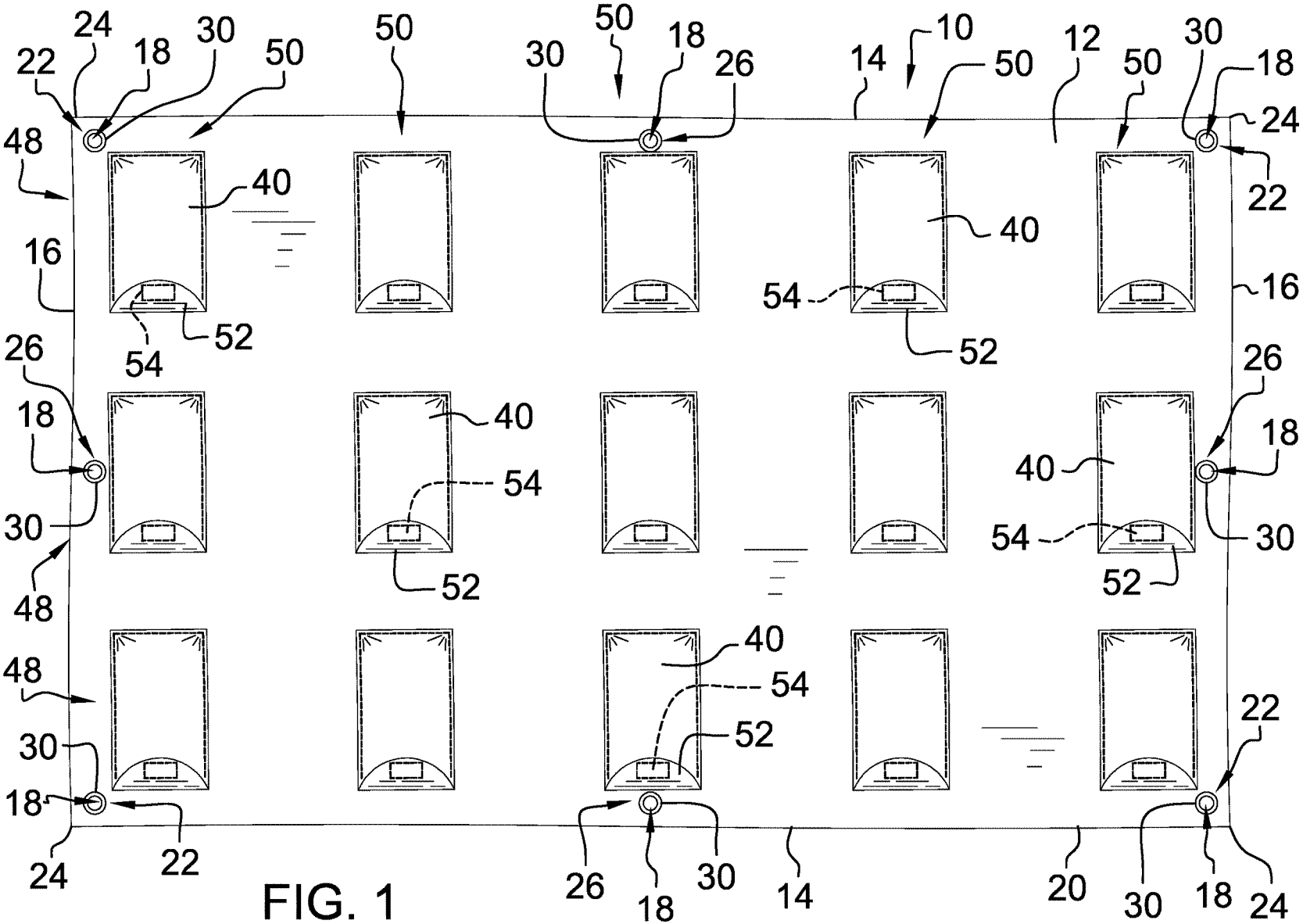
FIG. 1 is a front view of a weighted tarpaulin device according to an embodiment of the disclosure.
Figure 2:
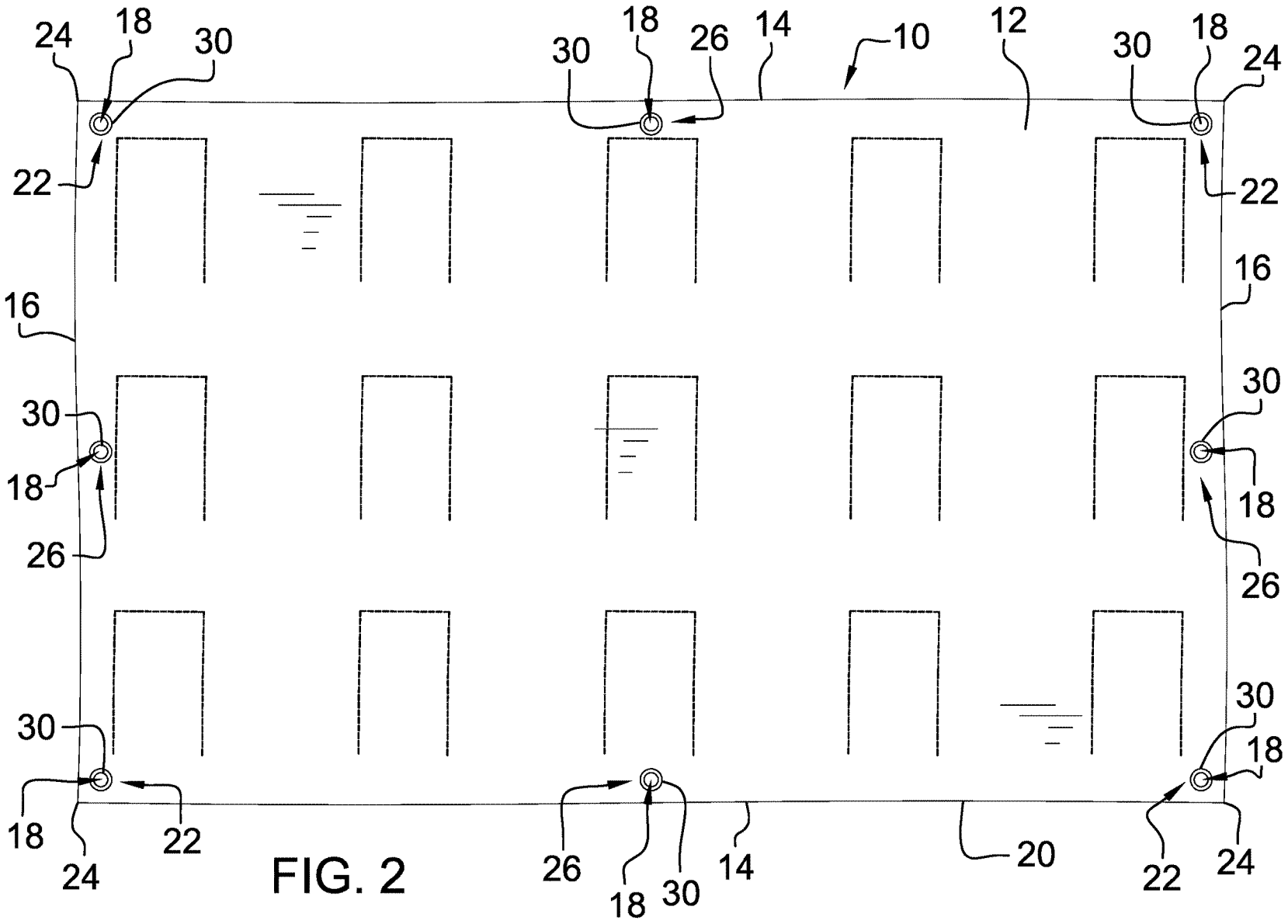
FIG. 2 is a rear view of an embodiment of the disclosure.
Figure 3:
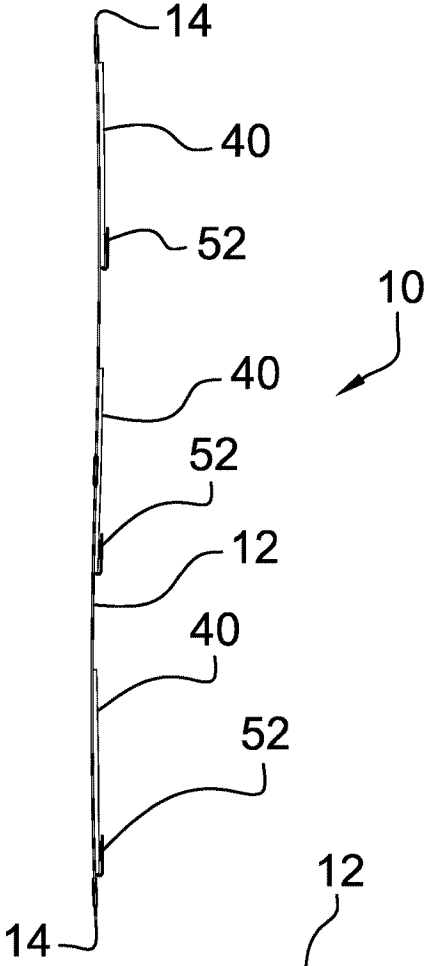
FIG. 3 is a side view of an embodiment of the disclosure.
Figure 4:
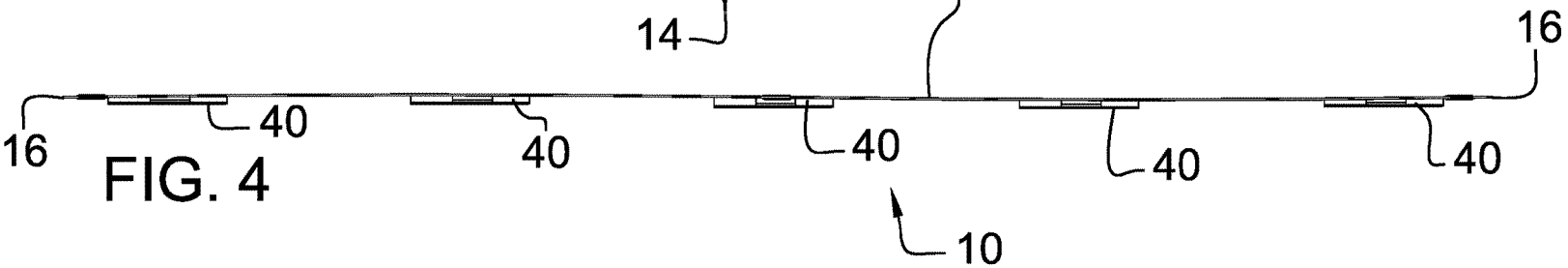
FIG. 4 is a top view of an embodiment of the disclosure.
Figure 5:
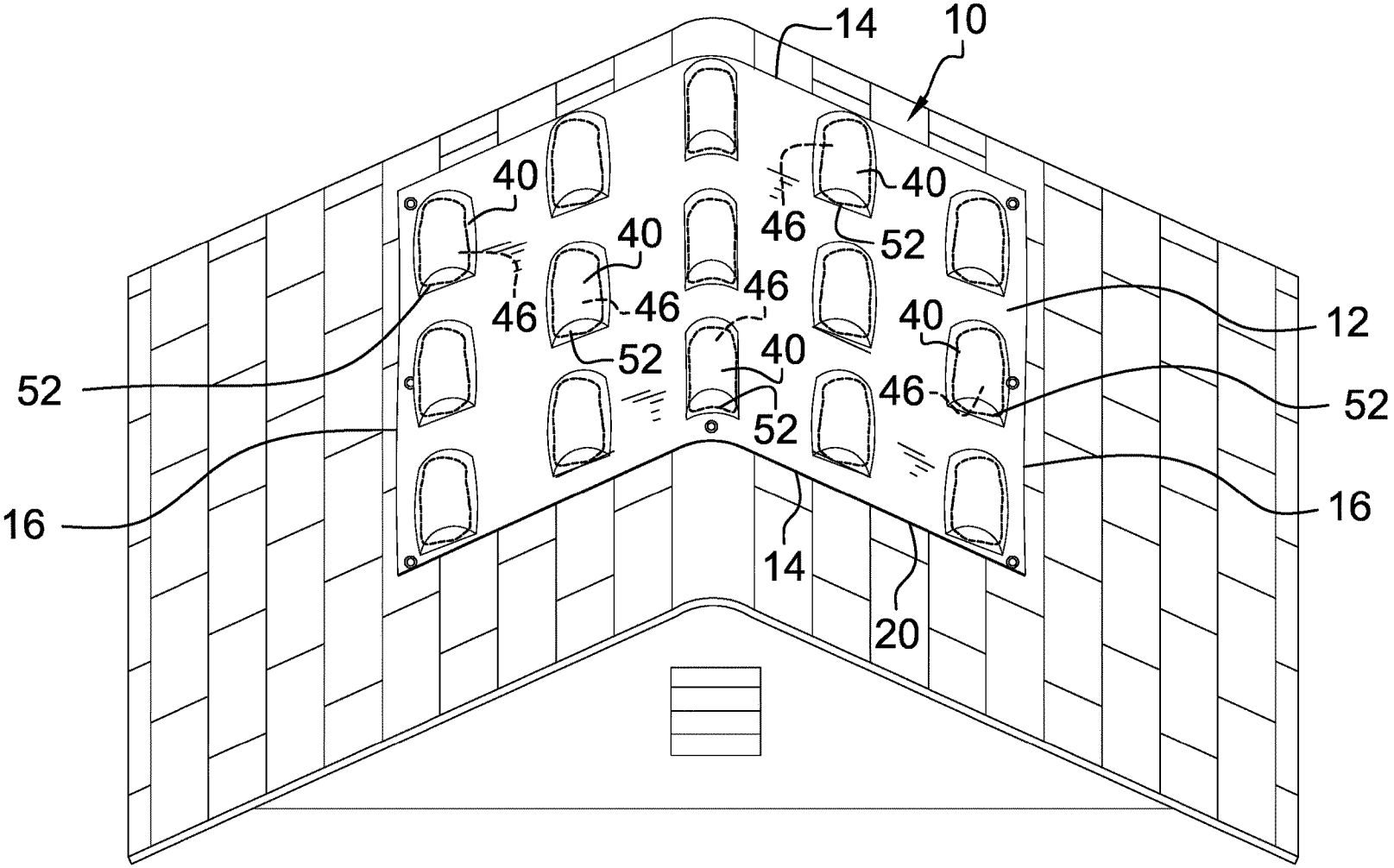
FIG. 5 is an in-use view of an embodiment of the disclosure.

With reference now to the drawings, and in particular to FIGS. 1 through 5 thereof, a new weighted tarpaulin embodying the principles and concepts of an embodiment of the disclosure and generally designated by the reference numeral 10 will be described.

As best illustrated in FIGS. 1 through 5, the weighted tarpaulin device 10 generally comprises a rectangular tarpaulin 12 having a pair of first opposing edges 14 and a pair of second opposing edges 16, wherein each first opposing edge 14 is longer than each second opposing edge 16. A plurality of holes 18 extends through the tarpaulin 12 and is positioned along a peripheral edge 20 of the tarpaulin 12. Each of a plurality of corner holes 22 of the plurality of holes 18 is positioned proximate an associated one of each of a plurality of corners 24 of the tarpaulin 12, and each of a plurality of edge holes 26 is positioned proximate a midpoint 28 of each first opposing edge 14 and each second opposing edge 16. Each of a plurality of grommets 30 is positioned around each hole 18 and coupled to the tarpaulin 12.

Each of a plurality of pocket panels 32 has an outer edge 34 comprising a first portion 36 and a second portion 38. The first portion 36 of the outer edge 34 of each pocket panel 32 is sewn to a face of the tarpaulin 12 such that each pocket panel 32 and the tarpaulin 12 cooperatively define a respective one of a plurality of pockets 40, each pocket 40 defining an associated chamber of a plurality of chambers 42. The second portion 38 of the outer edge 34 of each pocket panel 32 cooperates with the tarpaulin 12 to define an opening to the associated chamber. Each pocket 40 is configured for containing a sandbag 46 of a plurality of sandbags 46 wherein the plurality of sandbags 46 weighs down the tarpaulin 12 when contained in the plurality of pockets 40.

Each pocket panel 32 is rectangular, and the second portion 38 of the outer edge 34 of each pocket panel 32 comprising a side of the pocket panel 32. The second portion 38 of the outer edge 34 of each pocket panel 32 faces one of the first opposing edges 14 of the tarpaulin 12 when the tarpaulin 12 is in a planar position. The plurality of pocket panels 32 is positioned in a set of three evenly spaced rows 48 and a set of five evenly spaced columns 50, wherein each row 48 is parallel to each first opposing edge 14 of the tarpaulin 12 and each column 50 is parallel to each second opposing edge 16 of the tarpaulin 12 when the tarpaulin 12 is in the planar position.

Each of a plurality of pocket flaps 52 is coupled to the tarpaulin 12 adjacent to an opening to an associated chamber of the plurality of chambers 42. Each pocket flap 52 is releasably securable to an associated pocket panel 32 of the plurality of pocket panels 32 such that the opening to the associated chamber is closed. Each of a plurality of hook-and-loop fasteners 54 releasably secures an associated pocket flap 52 of the plurality of pocket flaps 52 to an associated pocket panel 32 of the plurality of pocket panels 32.

In use, each of the pockets 40 are filled with one of the plurality of sandbags 46. Each of the pocket flaps 52 is secured via the associated hook-and-loop fastener 54 to the pocket panel 32, thereby closing the opening and securing the associated sandbag 46 within the associated chamber. The tarpaulin 12 is weighed down by the sandbags 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weighted tarpaulin device comprising:

a tarpaulin, said tarpaulin being rectangular, said tarpaulin having a pair of first opposing edges and a pair of second opposing edges; and a plurality of pocket panels, each said pocket panel having an outer edge, said outer edge of each said pocket panel having a first portion and a second portion, said first portion of said outer edge of each said pocket panel being coupled to a face of said tarpaulin, each said pocket panel and said tarpaulin cooperatively defining a respective one of a plurality of pockets, each said pocket panel being dispersed across said face of said tarpaulin, each said pocket defining an associated chamber of a plurality of chambers, said second portion of said outer edge of each said pocket panel cooperating with said tarpaulin to define an opening to said associated chamber, each said pocket being configured for containing a sandbag of a plurality of sandbags wherein the plurality of sandbags weighs down said tarpaulin when contained in said plurality of pockets, said plurality of pocket panels being arranged in a set of rows and a set of columns, said pocket panels of each row of said set of rows being spaced apart from each other at even intervals, said pocket panels of each column of said set of columns being spaced apart from each other at even intervals, each said row being parallel to each said first opposing edge of said tarpaulin when said tarpaulin is in said planar position, each said column being parallel to each said second opposing edge of said tarpaulin when said tarpaulin is in said planar position, said plurality of pocket panels including a central pocket panel which is positioned at a center point of said tarpaulin, said center point being equidistant from each of the first opposing edges and equidistant from each of the second opposing edges.

2. The device of claim 1, further comprising each said first opposing edge being longer than each said second opposing edge.

3. The device of claim 2, further comprising:

a plurality of holes, said plurality of holes extending through said tarpaulin and being positioned along a peripheral edge of said tarpaulin; and a plurality of grommets, each said grommet being positioned around each said hole and coupled to said tarpaulin.

4. The device of claim 3, further comprising each of a plurality of corner holes of said plurality of holes being positioned proximate an associated one of each of a plurality of corners of said tarpaulin, each of a plurality of edge holes being positioned proximate a midpoint of each first opposing edge and each second opposing edge.

5. The device of claim 2, further comprising said second portion of said outer edge of each said pocket panel facing one of said first opposing edges of said tarpaulin when said tarpaulin is in a planar position.

6. The device of claim 1, further comprising:

a plurality of holes, said plurality of holes extending through said tarpaulin and being positioned along a peripheral edge of said tarpaulin; and a plurality of grommets, each said grommet being positioned around each said hole and coupled to said tarpaulin.

7. The device of claim 1, further comprising each said pocket panel being rectangular, said second portion of said outer edge of each said pocket panel comprising a side of said pocket panel.

8. The device of claim 1, further comprising each said pocket being releasably securable in a closed position.

9. The device of claim 1, further comprising a plurality of pocket flaps, each said pocket flap being coupled to said tarpaulin adjacent to an opening to an associated chamber of said plurality of chambers, each said pocket flap being releasably securable to an associated pocket panel of said plurality of pocket panels such that said opening to said associated chamber is closed.

10. The device of claim 9, further comprising a plurality of hook-and-loop fasteners, each said hook-and-loop fastener releasably securing an associated pocket flap of said plurality of pocket flaps to an associated pocket panel of said plurality of pocket panels.

11. A weighted tarpaulin device comprising:

a tarpaulin, said tarpaulin being rectangular, said tarpaulin having a pair of first opposing edges and a pair of second opposing edges, each said first opposing edge being longer than each said second opposing edge;

a plurality of holes, said plurality of holes extending through said tarpaulin and being positioned along a peripheral edge of said tarpaulin, each of a plurality of corner holes of said plurality of holes being positioned proximate an associated one of each of a plurality of corners of said tarpaulin, each of a plurality of edge holes being positioned proximate a midpoint of each first opposing edge and each second opposing edge;

a plurality of grommets, each said grommet being positioned around each said hole and coupled to said tarpaulin;

a plurality of pocket panels, each said pocket panel having an outer edge, said outer edge of each said pocket panel having a first portion and a second portion, said first portion of said outer edge of each said pocket panel being sewn to a face of said tarpaulin, each said pocket panel and said tarpaulin cooperatively defining a respective one of a plurality of pockets, each said pocket defining an associated chamber of a plurality of chambers, said second portion of said outer edge of each said pocket panel cooperating with said tarpaulin to define an opening to said associated chamber, each said pocket being configured for containing a sandbag of a plurality of sandbags wherein the plurality of sandbags weighs down said tarpaulin when contained in said plurality of pockets, each said pocket panel being rectangular, said second portion of said outer edge of each said pocket panel comprising a side of said pocket panel, said second portion of said outer edge of each said pocket panel facing one of said first opposing edges of said tarpaulin when said tarpaulin is in a planar position, said plurality of pocket panels being arranged in a set of rows and a set of columns, said pocket panels of each row of said set of rows being spaced apart from each other at even intervals, said pocket panels of each column of said set of columns being spaced apart from each other at even intervals, each said row being parallel to each said first opposing edge of said tarpaulin when said tarpaulin is in said planar position, each said column being parallel to each said second opposing edge of said tarpaulin when said tarpaulin is in said planar position, said plurality of pocket panels including a central pocket panel which is positioned at a center point of said tarpaulin, said center point being equidistant from each of the first opposing edges and equidistant from each of the second opposing edges;

a plurality of pocket flaps, each said pocket flap being coupled to said tarpaulin adjacent to an opening to an associated chamber of said plurality of chambers, each said pocket flap being releasably securable to an associated pocket panel of said plurality of pocket panels such that said opening to said associated chamber is closed; and a plurality of hook-and-loop fasteners, each said hook-and-loop fastener releasably securing an associated pocket flap of said plurality of pocket flaps to an associated pocket panel of said plurality of pocket panels.

* * * * *